US008919068B2

(12) United States Patent
Wright et al.

(10) Patent No.: US 8,919,068 B2
(45) Date of Patent: Dec. 30, 2014

(54) DEVICES, SYSTEMS, AND METHODS FOR EXTERIOR FLOORING

(71) Applicant: Pergo (Europe) AB, Trelleborg (SE)

(72) Inventors: Thomas S. Wright, Holly Springs, NC (US); Patrick George Smith, Raleigh, NC (US); Marc Schultze, Garner, NC (US)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 13/781,088

(22) Filed: Feb. 28, 2013

(65) Prior Publication Data

US 2014/0007526 A1 Jan. 9, 2014

Related U.S. Application Data

(63) Continuation-in-part of application No. 13/542,275, filed on Jul. 5, 2012.

(60) Provisional application No. 61/770,156, filed on Feb. 27, 2013.

(51) Int. Cl.

| | |
|---|---|
| ***E04B 2/00*** | (2006.01) |
| ***E04F 15/02*** | (2006.01) |
| ***E04B 5/02*** | (2006.01) |

(52) U.S. Cl.

CPC ..... *E04B 5/023* (2013.01); *E04F 15/02183* (2013.01); *E04F 2015/0205* (2013.01); *E04F 2201/0511* (2013.01)

USPC ..... 52/586.1; 52/302.1; 52/469

(58) Field of Classification Search

USPC ..... 52/582.1, 586.1, 586.2, 393, 395, 52/396.04, 396.05, 369.07, 396.1, 459, 52/460, 461, 462, 463, 464, 465, 466, 467, 52/468, 469, 470, 471, 472, 483.1, 489.1, 52/302.1; 404/47

See application file for complete search history.

(56) References Cited

U.S. PATENT DOCUMENTS

| | | | | |
|---|---|---|---|---|
| 3,443,350 | A * | 5/1969 | Birum, Jr. | 52/459 |
| 4,566,235 | A | 1/1986 | Groll | |
| 5,335,473 | A | 8/1994 | Chase | |

(Continued)

FOREIGN PATENT DOCUMENTS

| | | |
|---|---|---|
| DE | 20 2004 015 283.5 | 12/2004 |
| WO | WO 2012/168446 | 12/2012 |

OTHER PUBLICATIONS

U.S Appl. No. 13/542,275 dated Jul. 5, 2012.

*Primary Examiner* — William Gilbert
*Assistant Examiner* — Kyle Walraed-Sullivan
(74) *Attorney, Agent, or Firm* — Jenkins, Wilson, Taylor & Hunt, P.A.

(57) ABSTRACT

Novel devices, systems, and methods for providing exterior flooring that can be installed over existing exterior surfaces, such as surfaces of an outdoor deck, are provided herein. In some aspects, a joint device or joint member for an exterior floor covering can include a body portion and at least one tongue portion extending from the body portion. The joint device can be adapted to connect adjacent floor panels and secure the floor panels to an underlying surface. The joint device can, but is not required to pass liquid therebetween. The joint device and adjacent floor panels can be made of water resistant materials. The joint device can further include an optional opening adapted to receive an attachment member for attaching portions of the joint member to an underlying surface.

15 Claims, 7 Drawing Sheets

(56) References Cited

U.S. PATENT DOCUMENTS

| | | | | |
|---|---|---|---|---|
| 5,381,638 | A | 1/1995 | Andersson | |
| 5,694,730 | A * | 12/1997 | Del Rincon et al. | 52/586.1 |
| 6,248,342 | B1 * | 6/2001 | Trogolo et al. | 424/404 |
| 6,289,646 | B1 * | 9/2001 | Watanabe | 52/506.01 |
| 6,336,300 | B1 | 1/2002 | Babucke | |
| 6,484,467 | B2 | 11/2002 | Crout | |
| 6,694,691 | B2 | 2/2004 | Ku | |
| 7,313,893 | B2 * | 1/2008 | Voegele, Jr. | 52/461 |
| 7,793,483 | B2 | 9/2010 | Stanchfield | |
| 8,006,458 | B1 * | 8/2011 | Olofsson et al. | 52/582.1 |
| 2004/0244325 | A1 * | 12/2004 | Nelson | 52/582.1 |
| 2007/0196614 | A1 | 8/2007 | Kellner | |
| 2009/0313915 | A1 | 12/2009 | Kellner | |
| 2010/0095620 | A1 * | 4/2010 | Wilkes, Jr. | 52/396.04 |
| 2010/0126099 | A1 * | 5/2010 | Ben-Zvi | 52/582.1 |

* cited by examiner

DEVICES, SYSTEMS, AND METHODS FOR EXTERIOR FLOORING

CROSS REFERENCE TO RELATED APPLICATION

This application claims the benefit of and priority to U.S. Provisional Application No. 61/770,156, filed Feb. 27, 2013 and is a continuation in part of and claims priority to U.S. application Ser. No. 13/542,275, filed Jul. 5, 2012, the entire disclosure of which is incorporated by reference herein.

TECHNICAL FIELD

The subject matter disclosed herein relates generally to novel devices, systems, and methods for exterior flooring are provided. More particularly, the subject matter disclosed herein relates to novel devices, systems, and methods for providing jointed exterior flooring that can be installed over existing exterior surfaces, such as surfaces of an outdoor deck.

BACKGROUND

Easy to assemble, or "do it yourself" (DIY) floor panels have increased in popularity for use as replacements for interior parquet floors, linoleum sheet floors, and wall-to-wall carpets. Such floor panels offer consumers durable and aesthetically pleasing products at affordable price points. In conventional systems, opposing first and second edges of a floor panel are provided with a groove and a tongue, respectively, such that adjacent floor panels can directly engage and lock together. For example, a tongue of a first floor panel can engage and lock directly with a groove of a second floor panel. All four edges of a conventional floor panel can lock directly with one or more adjacent panels forming joints directly therebetween.

Conventional floor panels, systems, and methods have several disadvantages rendering them unsuitable for outdoor use and are therefore, unsuitable for use in exterior floor covering applications. For example, one disadvantage of conventional floor panels, systems, and methods is that there is no effective manner in which the panels can be secured for outdoor use. For example, conventional methods of gluing panels together may not be resistant to adverse weather, may be insufficient to secure the panels to exterior surfaces on windy days or during cleaning, and/or may be ineffective when exposed to the elements during outdoor use. Accordingly, a need remains for devices, systems, and methods for establishing suitable floor coverings adapted for exterior or outdoor use.

As an alternative to a floor covering, conventional wooden decks or outdoor floors can be replaced with new wood or a wood plastic composite structure. However, this option is typically not DIY and can be expensive. To date, a structurally stable and easy to assemble joint device for use as exterior floor coverings is lacking in the art.

Despite the availability of various devices, systems, and methods in the marketplace, a need remains for devices, systems, and methods for providing exterior floor coverings.

SUMMARY

In accordance with this disclosure, devices, systems, and methods for exterior flooring are provided and described herein. Devices, systems, and methods described herein can provide improved capabilities of securing exterior flooring elements to an existing or underlying outdoor structure. In some aspects, devices systems, and method described herein can provide improved and efficient moisture channeling capabilities from surfaces of a floor covering and can be well suited for a variety of exterior/outdoor applications such as an exterior floor covering installed over an existing real wood or non-wood deck, or over portions of an existing deck such as what can be done with an exterior area rug. It is, therefore, an object of the present disclosure to provide joint devices, systems, and methods for exterior flooring which offer beauty, ease of installation, and an alternative to replacing and/or refinishing an existing outdoor surface such as an aged wood deck.

These and other objects of the present disclosure as can become apparent from the disclosure herein are achieved, at least in whole or in part, by the subject matter disclosed herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1:
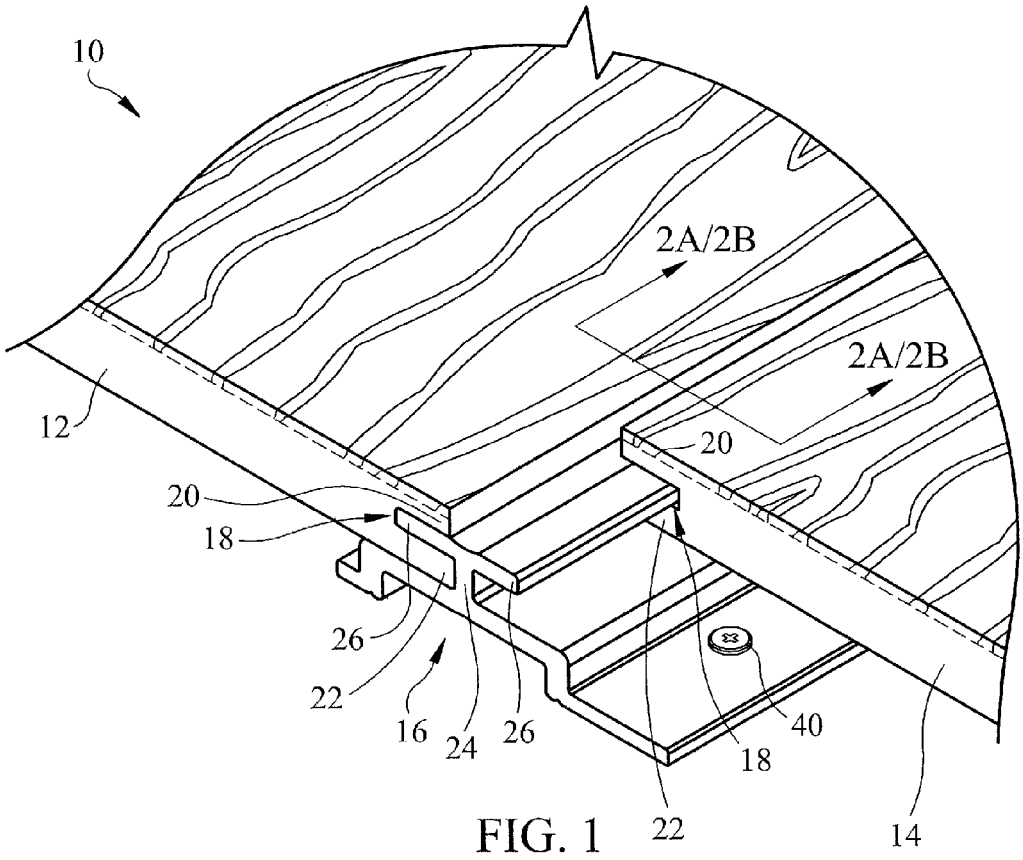
FIG. 1 is a top perspective view illustrating a joint device and system of floor panels for an exterior floor covering according to the disclosure herein.

The subject matter disclosed herein is directed to devices, systems, and methods for exterior floor coverings including, for example, a jointed floor covering suitable for outdoor use and installation over existing surfaces such as patio and/or real wood or non-wood type deck surfaces. Novel joint devices or joint members provided herein can be disposed between adjacent floor panels and can be temporarily or permanently secured to existing surfaces via optional attachment members. Novel joint devices or joint members can, but do not have to be, adapted to connect and pass liquid or moisture between adjacent panels.

In some aspects, novel joint devices or joint members described herein can comprise one or more openings, holes, pores, slots, channels, or porous section or area adapted to drain liquid. In other aspects, multiple joint devices or members can be provided between panels and spaced apart such that liquid can drain therebetween. In some aspects, liquid can be collected on an upper surface of the joint member and be drained or channeled through the joint member and out of the underlying flooring (e.g., decking) via openings or pores disposed within the body of the joint member. In further aspects, joint devices or members can comprise a porous body of material and/or porous sections of material incrementally spaced down the body of the joint member. The porous sections of material or body of material can be configured for draining liquid.

Novel joint devices or joint members can comprise a body portion and at least opening or hole through which at least one mechanical coupling member can be positioned. Notably, novel joint devices or joint members can be configured to hold the panels securely down over an existing underlying surface, while allowing a very small degree of movement of each panel. In some aspects, adjacent floor panels are not jointed or directly affixed to each other, but are rather are held in place via novel joint members or devices described herein. In some aspect, first and second floor panels are completely spaced apart via a gap, and the novel joint member or device is positioned within the gap.

In some aspects, novel joint devices or joint members can comprise a collection space for drained liquids can be disposed below the body portion. In some aspects, the collection space is defined by a liquid permeable spacer material. Novel joint members can, but do not have to include openings for draining liquids.

Notably, the joint device or member can extend in length and/or width to fill a gap between adjacent panels. In one embodiment, the joint member can be disposed longitudinally between adjacent first and second rectangular floor panels. At least a portion of a joint member can be positioned in a portion of a groove of one or more floor panels. In some aspects, the joint can, but does not have to allow liquid to drain from an upper surface of the floor panels towards a lower surface of the floor panels.

Notably, floor panels can be elevated above and not directly supported by portions of an underlying preexisting exterior structure, such as an outdoor deck or patio surface. Floor panels can be elevated over and/or above existing surfaces (e.g., not directly resting on the existing structure or surface) via a novel joint member and/or porous spacer member as described further below. Notably, devices or members provided herein can allow consumers to quickly and easily refinish exterior surfaces themselves, that is, the devices, systems, and methods disclosed herein can advantageously allow consumers to complete one or more "do it yourself" (DIY) projects.

Reference will be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

As illustrated in the various figures, some sizes of structures or portions are exaggerated relative to other structures or portions for illustrative purposes and, thus, are provided to illustrate the general structures of the present subject matter. Furthermore, various aspects of the present subject matter are described with reference to a structure or a portion being formed on other structures, portions, or both. As will be appreciated by those of skill in the art, references to a structure being formed "on" or "above" another structure or portion contemplates that additional structure, portion, or both may intervene. References to a structure or a portion being formed "on" another structure or portion without an intervening structure or portion are described herein as being formed "directly on" the structure or portion. Similarly, it will be understood that when an element is referred to as being "connected", "attached", or "coupled" to another element, it can be directly connected, attached, or coupled to the other element, or intervening elements may be present. In contrast, when an element is referred to as being "directly connected", "directly attached", or "directly coupled" to another element, no intervening elements are present.

Furthermore, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the component in addition to the orientation depicted in the figures. For example, if a component or feature in the figures is turned over, structure or portion described as "above" other structures or portions would now be oriented "below" the other structures or portions. Likewise, if components in the figures are rotated along an axis, structure or portion described as "above", other structures or portions would be oriented "next to" or "left of" the other structures or portions. Like numbers refer to like elements throughout.

Unless the absence of one or more elements is specifically recited, the terms "comprising", including", and "having" as used herein should be interpreted as open-ended terms that do not preclude the presence of one or more elements.

As used herein the terms "weatherproof" and "waterproof" are synonymous terms used interchangeably to describe materials that are inherently, or have been treated to become, resistant to penetration by water and wetting. Such terms can be water impervious. Weatherproof and waterproof materials can comprise natural or synthetic materials that can include, be laminated to, and/or be coated with a waterproofing material such as plastic, resin, rubber, polyvinyl chloride (PVC), polyurethane (PU), silicone elastomer, fluoropolymers, wax, or any other suitable material. In some aspects, weatherproof materials can include an extruded plastic, such as an extruded Acrylonitrile Styrene Acrylate (ASA) plastic. Weatherproof materials can also include metallic materials which can optionally be anodized and/or plated.

FIGS. 1 through 7 illustrate embodiments of devices, systems, and methods according to the present subject matter as disclosed and described herein. FIG. 1 is a top perspective view of a system generally designated 10 for an exterior floor covering. System 10 can comprise at least a first floor panel 12, a second floor panel 14, and a joint device disposed therebetween. The joint device can be adapted to fill a gap between adjacent edges of first and second floor panels 12 and 14, respectively, and can be configured to effectively drain liquid between the panels. The joint device can but does not have to include openings and/or porous body sections for channeling and/or draining liquids. In some aspects, the joint device can comprise one or more openings for receiving a mechanical coupling member for securing first and second floor panels 12 and 14 to an underlying structure or surface. In some aspects, the joint device or joint member can be configured to hold the panels down or securely to an underlying surface while allowing a very small degree of movement of each panel.

In some aspects, the joint device can be configured to elevate first and second floor panels 12 and 14 above an underlying structure or surface, such as an outdoor patio or deck. That is, first and second floor panels 12 and 14 do not directly touch and/or may not be directly supported or disposed over the underlying surface. One or more gaps or spaces provided by elevating first and second floor panels 12 and 14 can allow liquid to collect therein and subsequently drain or pass through portions of the underlying structure, such as by allowing liquid to drain through cracks between adjacent decking panels or planks. First and second floor panels 12 and 14 and the joint device can comprise weatherproof materials suitable for outdoor use. In one embodiment, the joint device between adjacent panels can comprise a discrete joint member that can be separate and distinct from first and second floor panels 12 and 14. In some aspects, the joint device between panels 12 and 14 can comprise a joint member, generally designated 16. Joint member 16 can be configured to hold the panels together and over the underlying surface while allowing a very small degree of movement between each panel. In some aspects, panels 12 and 14 are not jointed or directly affixed to each other, but rather are held in place via joint member 16. In some aspects, joint member 16 can comprise a clip adapted to secure and completely separate adjacent panels. In some aspects, a plurality of joint member 16 can be used end-to end between panels 12 and 14, and can be spaced apart and/or otherwise configured to drain liquid between spaces between the ends of the joint members.

First and second floor panels 12 and 14 can comprise non-structural (i.e., structural sub-flooring required) components such that when joined via joint member 16, floor panels 12, 14, and joint member 16 can collectively provide a floor covering similar to an exterior area rug configured for application or installation directly over an existing exterior surface. In some aspects, floor panels 12 and 14 can lock together without requiring glue and without being glued to the surface of the underlying exterior floor structure or surface. Thus, system 10 can advantageously comprise a mobile and reusable floor covering that can quickly and easily become assembled and disassembled without requiring application or removal of glued components. In other aspects, portions of system 10 can but do not have to be mechanically coupled to portions of the underlying exterior floor structure as described further below First and second floor panels 12 and 14 can comprise a single layer structure that can consist entirely of any substantially weather and water-resistant, water impervious, or waterproof material, a plastic material, a compact laminate, a laminate material, or a wood plastic composite material suitable for exterior use. In other aspects, first and second floor panels 12 and 14 can comprise a multi-layered structure, as indicated by the phantom lines in FIG. 1, where each layer can be the same material and/or different materials. Each entire first and second floor panel 12 and 14, and/or portions thereof, can comprise at least one layer of weatherproof plastic or composite material capable of withstanding exterior environmental conditions such as, for example, PVC or a wood plastic composite material.

In some aspects, first and second floor panels 12 and 14 can comprise a multi-layered structure where the panels 12, 14 include a core or base layer and a surface layer. One or more optional abrasion resistant layers are also contemplated. The base layer can comprise the same or a different material(s) than the surface layer. The surface layer can comprise a decorative layer adapted to emulate wood, stone, tile, brick, etc. In some aspects, the base layer can comprise a plastic material, a composite material, or a cellulosic material, such as wood particles, impregnated with a resin, such as a thermoplastic material. The surface layer can comprise a layer of weatherproof decorative plastic, composite, or thermosetting material that can optionally be glued or laminated on top of the base layer, where used.

In some aspects, first and second floor panels 12 and 14 can comprise one or more layers of a compact laminate material. That is, in some aspects, first and second floor panels 12 and 14 can include a multi-layered structure comprised of materials such as compact laminate, where there is no fiberboard core, but rather many layers of laminate bonded together. Any single or multi-layered structure comprising any material(s) is contemplated and can be provided herein.

In some aspects, floor panels 12 and 14 can for example comprise a high pressure laminate adhered to a particle board such as TRICOYA®, designed and manufactured by MEDITE®. A paper backing may be used and is contemplated herein. In some aspects, first and second floor panels can comprise a multi-layered stack including a paper backing layer that can be approximately 0.1 mm to 0.5 mm thick, a TRICOYA® core layer that can be approximately 6 to 8 mm thick and disposed over the paper backing, and a laminate decor layer that can be approximately 0.35 mm to 0.5 mm thick and disposed over the core layer. However, any materials and/or thicknesses are contemplated herein.

In some aspects, a core of floor panels 12 and 14 can comprise a wood particle or wood fibreboard having a thickness swelling when submersed for 24 hours of less than approximately 12% or even of less than approximately 8%, measured for example in accordance with EN317. Preferably use is made of a board consisting of glued acetylated wood particles or fibers. The acetylation of wooden particles or fibers results in a lower possible thickness swelling of the particles or fibers, and therefore to a more moisture resistant board. For the glue preferably use is made of an urea-formaldehyde glue, a melamine-urea-formaldehyde or a methyl diisocyanate based glue, such as methylene diphenyl diisocyanate based glue. In a preferred aspect, use is made of a board sold under the TRICOYA® brand as described in WO 2012/168446.

First and second floor panels 12 and 14 can comprise any size, shape, dimension, color, surface design, and/or finish (e.g., stain or abrasion resistant surface finishes including aluminum oxide $Al_2O_3$ finishes). In some aspects first and second floor panels 12 and 14 can comprise substantially rectangular shaped floor planks having a surface design that emulates wood and/or wood grain. In other aspects, first and second floor panels 12 and 14 can comprise substantially square shaped floor planks having a surface design that emulates stone, tile, or brick. First and second floor panels 12 and 14 can comprise shapes having more or less than four sides, such as circular, non-circular, triangular, pentagonal, hexagonal, or octagonal shapes, or any other suitable regular or irregularly shaped panel, as desired. Any combination of shape, surface design, and/or finish is contemplated herein.

First and second floor panels 12 and 14 can comprise any width and/or length, such as panels having at least one side measuring approximately 2 centimeters (cm) or more, approximately 10 cm or more, approximately 20 cm or more, approximately 1 foot (ft.) or more, or more than 1 ft. in length and/or width. In further aspects, floor panels 12 and 14 can also be between approximately 2 and 15 inches wide, for example, approximately 3, 5, 8, or 12 inches in width. Floor panels 12 and 14 can for example be between approximately 2 and 20 feet in length, such as approximately 4, 8, 12, and 16 feet in length. In yet further aspects, first and second floor panels 12 and 14, respectively, can for example comprise a width of approximately 100 mm or more and a length that is approximately 1000 mm or more, such as panels that are approximately 150 mm×1235 mm. First and second floor panels 12 and 14 can also comprise for example a width that can be approximately 100 mm or more and a length that can be approximately 2000 mm or more, such as panels that are approximately 150 mm×2425 mm. Any dimension of length and/or width is contemplated herein.

Floor panels 12 and 14 can comprise for example an overall thickness between approximately 2 mm and 18 mm (e.g., including overall thickness of all layers where multiple layers are used). For example, floor panels 12 and 14 can be approximately 4 mm, 6 mm, 8 mm, 10 mm, 12 mm, or 15 mm thick. Any dimension of panel thickness is contemplated herein.

Still referring to FIG. 1, a novel joint member 16 can be disposed between portions of first and second floor panels 12 and 14, for example, in a gap between panels. In some aspects, multiple joint members 16 can be assembled end-to-end between panels (e.g., FIG. 7), and can be configured to drain liquid between adjacent ends. In some aspects, the ends of joint members 16 can comprise porous sections of material and/or be configured to form an opening when assembled end-to-end, such that liquid can drain therebetween. Joint member 16 can be adapted to secure adjacent panels together and/or to portions of an underlying surface while allowing a very small degree of movement of each panel. In some aspects, adjacent panels may not be directly affixed to each other, but can rather be held in place via joint member 16. Joint member 16 can, but does not have to comprise liquid channeling capabilities.

In some aspects, at least one joint member 16 can be disposed along and/or adjacent at least one lateral edge of each panel in system 10. However, more than one joint member 16 can be disposed along and/or adjacent more than one lateral edge of each panel in system 10. For example, a first joint member 16 can be disposed adjacent a first lateral edge of at least one panel in system 10. In other aspects, two joint members 16 (e.g., a first joint member and a second joint member) can be disposed adjacent opposing first and second lateral edges of at least one panel in system 10. In yet further aspects, more than two joint members 16 (e.g., a first, a second, a third, a fourth, etc. joint member) can be disposed adjacent more than two lateral edges of at least a first panel of system 10. Joint member 16 can be configured to engage portions, for example, lateral edge portions, of one or more floor panels within system 10.

Figure 2A:
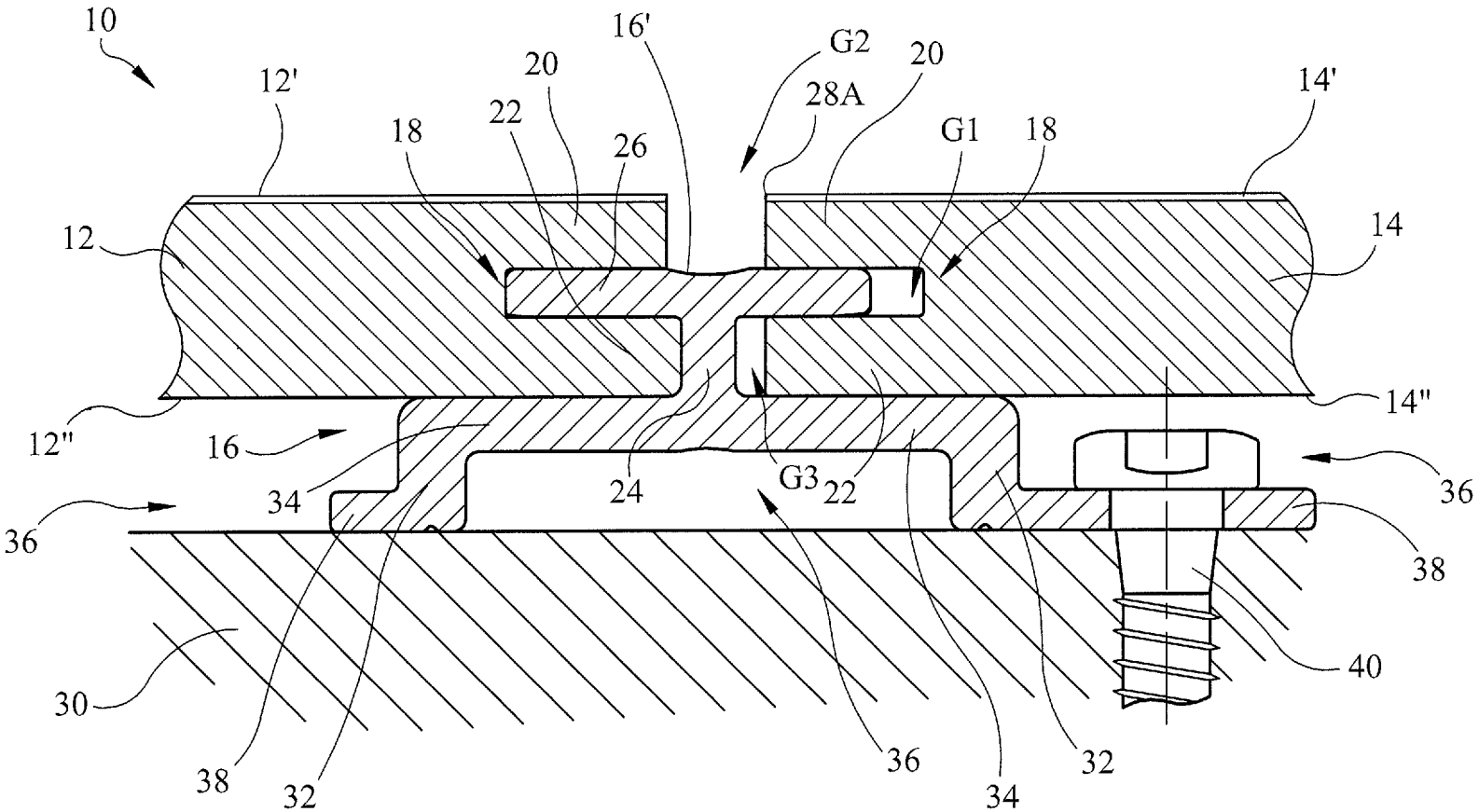
FIGS. 2A and 2B are sectional views illustrating the joint device and system of floor panels of FIG. 1, according to the disclosure herein.
Figure 2B:
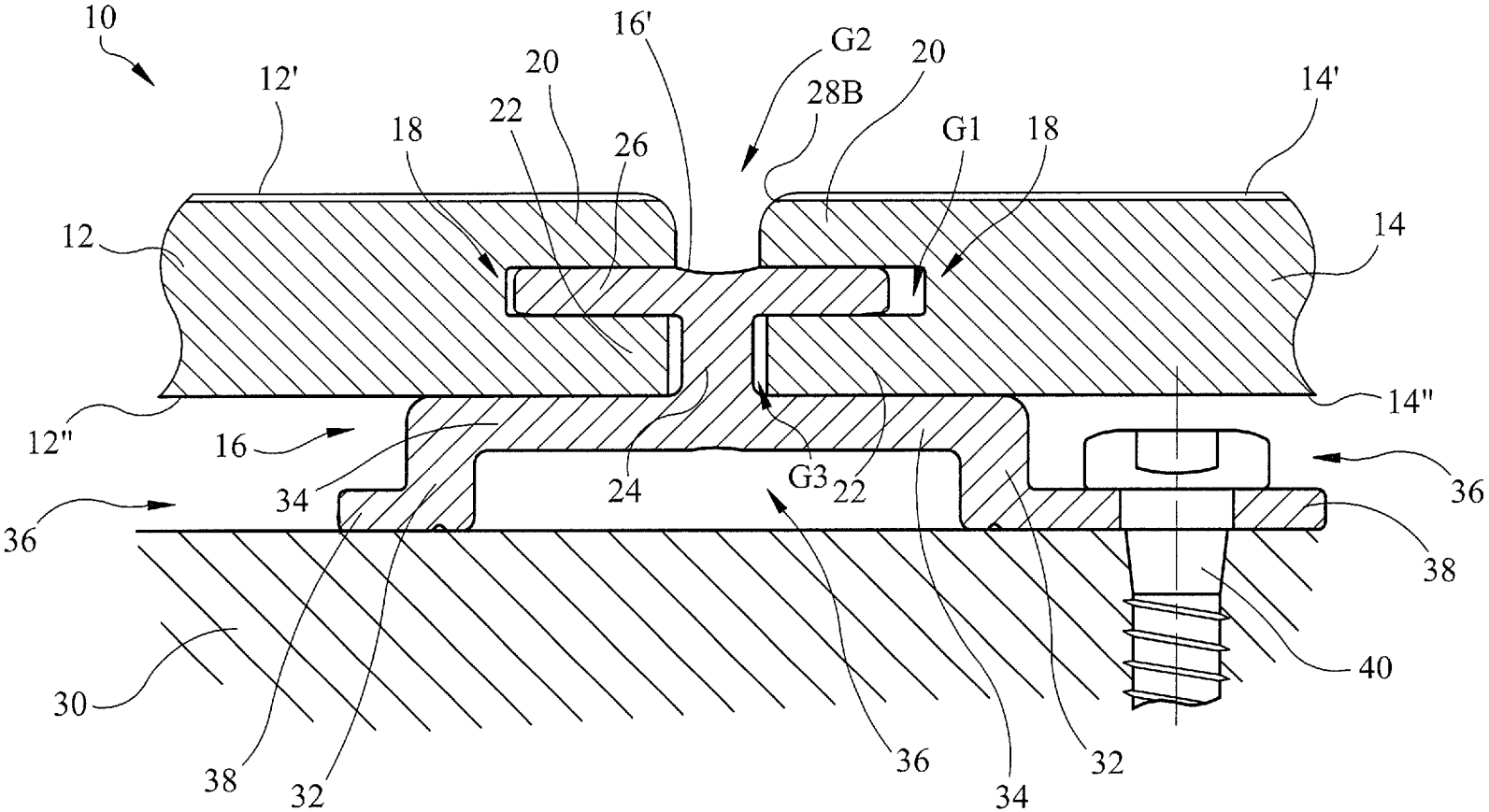

In some aspects, joint member 16 can be configured to elevate first and second floor panels 12 and 14 over an underlying surface (30, FIGS. 2A and 2B). Notably, elevating first and second floor panels 12 and 14 over portions of the underlying surface can provide a space for liquid to collect and subsequently drain from portions of the underlying surface. That is, liquid that may be collected from an upper surface of a floor covering comprised of one or more floor panels (e.g., 12 and 14) and/or joint members 16 can optionally become channeled between portions of the panels. System 10 can advantageously provide a jointed floor covering system suitable for exterior use and suitable for simple, DIY installation over an existing outdoor surface or structure.

In some aspects, joint member 16 can at least partially or entirely comprise a flexible material. In some aspects, joint member 16 can be rollable such that it can be provided in a roll and subsequently cut to size. Joint member 16 can in some aspects comprise at least partially or entirely a plastic material or a wood plastic composite material that can be adapted to bend or flex along between first and second floor panels 12 and 14. This can be advantageous as portions of the underlying surface may not be substantially flat. In some aspects, joint member 16 can comprise an ASA plastic material that is weather resistant, UV resistant (e.g., resistant to ultra violet (UV) light or sunlight) and heat resistant, thereby being advantageous for use in outdoor applications. In some aspects, joint member 16 can be provided via extruding ASA plastic. Joint member 16 and/or first and second floor panels 12 and 14 can be adapted to be water impervious and fade resistant when exposed to sunlight. This can be advantageous, as floor panels within system 10 can maintain a given color point over time and not appear substantially faded or weathered soon after initial installation.

It is also within the scope of the subject matter herein to manufacture the joint member 16 out of a solid, yet flexible and/or bendable material as noted previously, such as a natural or synthetic rubber. In this embodiment, the joint member 16 can flex or bend to allow for situations where the subsurface may not be completely flat.

In yet further aspects, joint member 16 can also at least a partially or entirely comprise a stiff material. In some aspects, joint member 16 can for example be a metal or metal alloy material, such as aluminum (Al), alloys thereof, or any stamped or rolled metal, plastic or composite material or any other suitable material adapted to withstand exterior environmental conditions. Joint member 16 can include an extruded material or metal (e.g., extruded Al), an anodized material or metal (e.g., anodized Al), and/or a plated material or metal. Whether joint member 16 is a stiff or flexible material, joint member 16 can in some aspects be cut to any desired length or lengths suitable, for example, for a number of different lengths or the entire length of the surface below. The length of joint member 16 is therefore not limited to being the length of the floor panels described herein. In some aspects, joint member 16 can for example comprise a length of approximately 1 to 6 meters (m), or values or sub-ranges thereof, such as approximately 2 m, approximately 2.5 m, or more than approximately 4 m.

Portions of joint member 16 can be adapted to fittingly engage and/or lock within portions of floor panels within system 10. That is, in some aspects, adjacent panels within system 10 may not directly engage each other, but only portions of joint members 16. Still referring to FIG. 1, each of first and second floor panels 12 and 14 can comprise opposing edges disposed on outermost opposing lateral sides where each lateral edge is provided with at least one groove, generally designated 18. In some aspects, the at feast one groove 18 can be longitudinally disposed along a length of opposing long edges of first and second floor panels 12 and 14, for example, where the panels are rectangular in shape. Groove 18 can be provided in first and second floor panels 12 and 14 via any suitable mechanical processing techniques including, for example, machining, milling, drilling, or any other suitable mechanical material removal process.

Groove 18 can comprise a void adapted to engage a projection portion of joint member 16, where groove 18 can be defined by at least an upper groove definition 20 and a lower groove definition 22. In some embodiments, upper and lower groove definitions 20 and 22 can be identical in length. In other aspects, lower groove definition 22 can extend further in length than upper groove definition 20 to provide for improved and more efficient locking and/or rotatable click assembly with a locking member, such as a tongue or projection of joint member 16. In some aspects, groove 18 can extend the full length of the long edges along each of the first and second floor panels 12 and 14. In other aspects, groove 18 can be intermittently spaced along portions of the long edges along the length of panels 12 and 14.

It is within the scope of the disclosed subject matter to design joint member 16 to permit assembly of system 10 via solely rotational movement, solely vertical movement, solely horizontal movement or any combination of rotational, horizontal, and vertical movements. That is, joint member 16 can be designed such that first and second floor panels 12 and 14 can rotationally engage and lock with portions of joint member 16, engage and lock via solely vertical movement, engage and lock via solely horizontal sliding movement (e.g., horizontally tapping, pushing, or sliding portions of panels against portions of joint member), or any combination thereof. Moreover, the joint between either of the panels 12 and 14 and the joint member 16 may be designed to include "play" and/or "pretension" where, after assembly, the panels 12 and 14 may be slightly displaced relative to each other along the length of the joint.

With respect to floor panels 12 and 14, portions of groove 18 can be configured to engage and/or lockingly engage a correspondingly shaped portion of locking member or tongue of joint member 16. As described further below with respect to FIGS. 2A and 2B, joint member 16 can comprise a body portion 24 that can be disposed between one or more locking portions or projections, such as for example one or more tongue portions 26. In some aspects, body portion 24 can be centrally disposed with respect to two tongue portions 26. In other aspects, body portion 24 can be non-centrally disposed with respect to tongue portions 26. In some aspects, joint member 16 can comprise two opposing tongue portions 26 adapted to engage opposing lateral edges or faces of opposing first and second floor panels 12 and 14.

Each tongue portion 26 provided on joint member 16 can be adapted to lock with, such as by matingly engaging, grooves 18 disposed in adjacent first and second floor panels 12 and 14, respectively. Locking engagement between joint member 16 and grooves 18 of adjacent panels can be achieved for example by frictional engagement between protrusions of joint member 16 and correspondingly shaped recesses of groove 18. In some aspects, tongue portions 26 of joint member 16 can click or snap into respective grooves 18 of floor panels 12 and 14. Tongue portions 26 can, but do not have to extend the full length of groove 16. In some aspects as illustrated by FIGS. 2A and 2B, joint member 16 can comprise more than one opposing tongue portion 26, and each tongue portion 26 can comprise a different length. In other aspects, each tongue portion 26 can be identical in length.

Notably, joint member 16 can be, but does not have to be a watertight joint and can instead allow water or other liquids to pass between floor panels 12 and 14 and may be, therefore, unexpected in light of conventional floor panel designs consisting substantially of tight fitting and watertight joints. Joint member 16 can, but does not have to comprise one or more slots, apertures, holes, or openings (94, FIG. 5) disposed along its length. In other aspects, liquid can be collected on an upper surface of joint member 16 and be drained or channeled through the joint member and out of the underlying flooring (e.g., decking) via openings or pores disposed within the body of the joint member. In further aspects, joint member 16 can comprise a wholly porous body of material or a body having multiple porous sections of material incrementally spaced down the body of the joint member where indicated by openings 94. The porous sections of material or body of material can be configured for draining liquid.

Where used, openings (94, FIG. 5) can be formed in joint member 16 during a molding process or openings can be mechanically formed via machining, drilling, punching, stamping, or any other mechanical process for removing material from a structure. Openings (94, FIG. 5) can be disposed within a body portion of joint member and can extend between upper and lower surfaces of joint member and into a collection space, area, or liquid permeable spacer (100, FIG. 5) comprising a collection space disposed between first and second floor panels 12 and 14, such that liquid can be collected and drained from the underlying surface.

FIGS. 2A and 2B illustrate cross-sectional views of system 10 described in FIG. 1. As previously noted, system 10 can comprise a floor covering joint system for covering outdoor surfaces or existing outdoor floor structures such as patios or decks. For example, system 10 can be disposed over an underlying surface 30. Notably, joint member 16 can be adapted to secure panels to underlying surface 30 via mechanically coupling thereto. Underlying surface 30 can comprise an existing outdoor surface such as a deck, for example a deck comprising a plurality of deck planks. Notably, system 10 can be easily installed directly over portions of underlying surface 30 via clicking, engaging, or locking edges of opposing panels to joint member 16, without requiring removing, refinishing, sanding, painting, staining, etc. of underlying surface 30. Thus, consumers can quickly and easily enjoy a new deck without having to destroy and/or replace the old deck and start over.

As described above, system 10 can comprise at least a first floor panel 12, second floor panel 14, and joint member 16 disposed therebetween. First and second floor panels 12 and 14 can comprise "female" or grooved profiles or edges (e.g., groove 18). Joint member 16 can comprise two "male" or tongued profiles or edges (e.g., tongue portions 26). Joint member 16 can also be adapted to join panels having two "male" profiles and/or a first panel having a "male" profile and a second floor panel having a "female" profile as described in commonly assigned, co-pending U.S. application Ser. No. 13/542,275 filed on Jul. 5, 2012, the disclosure of which is entirely incorporated herein by reference. Systems described herein can also comprise a plurality of panels and joint members as shown and described in FIGS. 4 and 7. Notably, each of first and second floor panels 12 and 14, respectively and joint member 16 can comprise a weatherproof material suitable for outdoor use. In some aspects, portions of first and second floor panels 12 and 14 and joint member can each comprise plastic.

As FIGS. 2A and 2B illustrate, first and second floor panels 12 and 14, respectively, can comprise substantially flat upper surfaces 12' and 14'. Alternatively, and as described in aforementioned co-pending and commonly assigned U.S. application Ser. No. 13/542,275, which has been incorporated herein by reference in the entirety, first and second floor panels 12 and 14 can comprise non-flat upper surfaces, or portions thereof can be non-flat. In yet further embodiments, first floor panel 12 can comprise a substantially flat upper surface and a portion of second floor panel 14 can comprise a different, non-flat upper surface. Panels having the same and/or different substantially flat or non-flat surfaces are contemplated herein.

FIG. 2A illustrates floor panels 12 and 14 can have squared or sharp edges 28A. FIG. 2B illustrates floor panels 12 and 14 having rounded or soft edges 28B. Body portion 24 of joint member 16 can be centrally or non-centrally disposed between sharp or soft edges 28A and 28B of adjacent floor panels. In some aspects, at least an upper surface of body portion 24 can be visible when viewed from above. One or more gaps can be disposed between body portion 24 of joint member 16 and at least one floor panel (e.g., gaps G3 in FIGS. 2A and 2B). In other aspects, body portion 16 can be substantially flush between first and second floor panels 12 and 14, but still not be water tight. That is, joint member 16 can, but does not have to, allow small amounts of liquid to pass therebetween. For illustration purposes, first and second floor panels 12 and 14 have edges that can be sharp and/or soft, however, panels can comprise any shape, configuration, and/ or cross-sectional shape of edges. First and second floor panels 12 and 14 can, but do not have to have edges that are the same shape.

In some aspects, joint member 16 can comprise a weatherproof spacer for providing one or more gaps between first floor panel 12 and second floor panel 14. In some aspects, gaps can be configured for draining liquid. In other aspects, gaps can allow panels to swell and/or flexibly move or incorporate "play" as needed. For example, a first gap G1 can be disposed between portions of joint member 16 and groove 18 of second floor panel 14. As noted earlier, and in some aspects joint member 16 can comprise one or more tongue portions 26. Tongue portions 26 can be disposed on opposing edges or surfaces of body portion 24 of joint member 16. Opposing tongue portions 26 can, but do not have to comprise different lengths. Opposing tongue portions 26 can, but do not have to comprise the same length as the length of corresponding grooves 18. In some aspects, a first tongue portion 26 engaging first floor panel 12 can be longer than a second tongue portion 26 engaging second floor panel 14. A first gap G1 can be disposed between the shorter tongue portion 26 and second floor panel, as tongue portion 26 may extend and stop short of substantially the full length of groove 18 of second floor panel 14.

Notably, joint member 16 can comprise one or more leg portions 32 adapted to elevate lower surfaces 12" and 14" of first and second floor panels, respectively above underlying surface 30. Leg portions 32 can extend from body portion 24, for example, from opposing support portions 34. In some aspects, support portions 34 can be configured to engage and support lower surfaces 12" and 14" or portions of lower surfaces 12" and 14" of respective first and second floor panels 12 and 14. Elevating first and second floor panels 12 and 14 above underlying surface 30 can provide one or more liquid permeable collection spaces generally designated 36. Collection spaces 36 can be open (i.e., comprised of air), which liquid can permeate and flow through. In other aspects, a liquid permeable material (e.g., spacer 100, FIG. 6) can be provided within a portion of at least one collection space 36.

Figure 5:
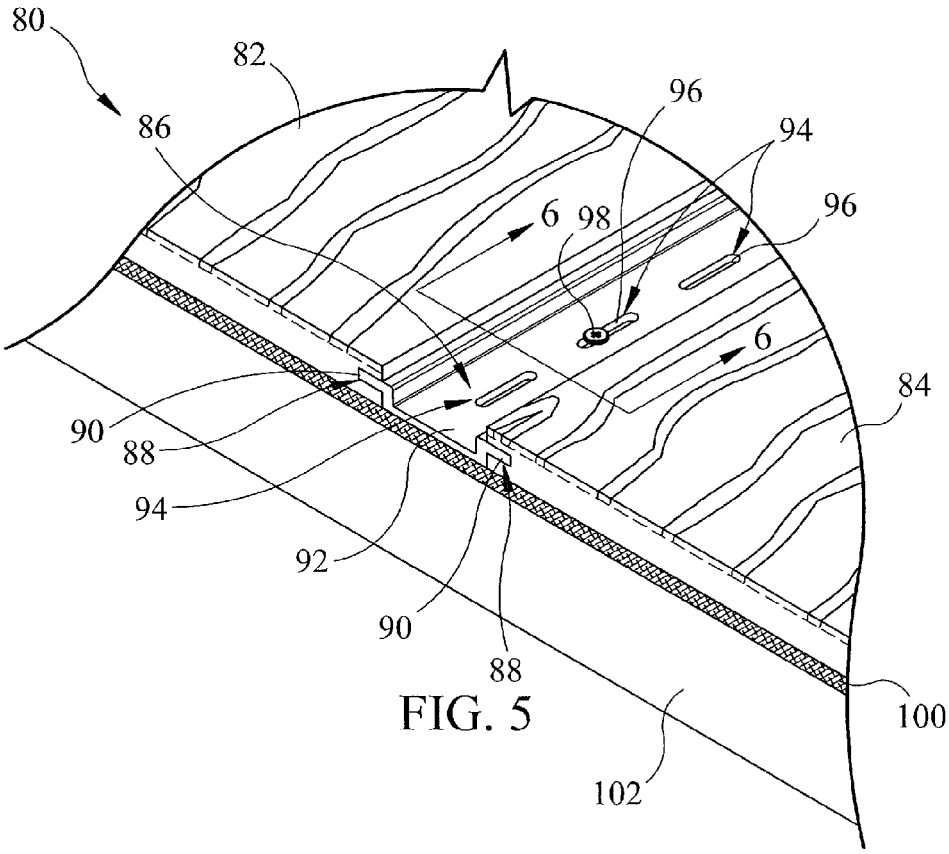
FIG. 5 is a top perspective view illustrating a further embodiment of a joint device and system of floor panels for an exterior floor covering according to the disclosure herein.
Figure 6:
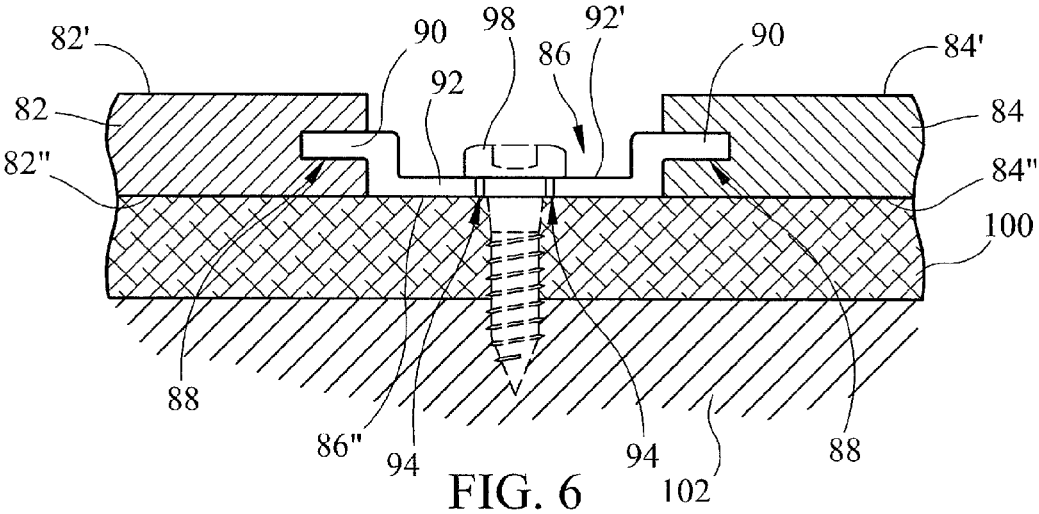
FIG. 6 is a sectional view illustrating the joint device and system of floor panels of FIG. 5, according to the disclosure herein.
Figure 7:
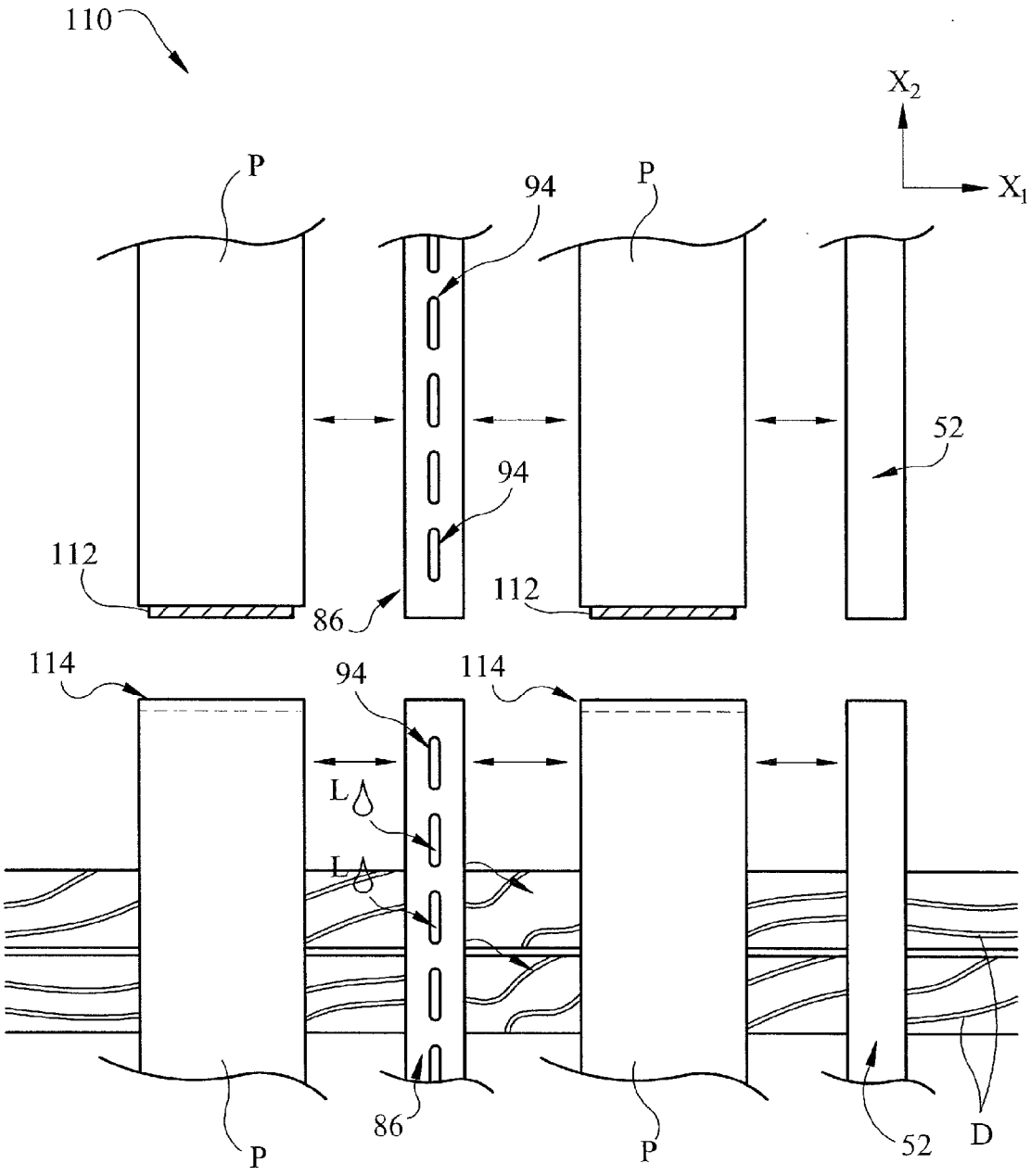
FIG. 7 is a schematic top view illustrating a floor covering or joint system comprising a plurality of joint devices according to the disclosure herein.

In some aspects, liquid can be drained from upper surfaces 12' and 14' of respective first and second floor panels 12 and 14, between joint member (e.g., where joint member is porous and/or has openings as described in FIGS. 5-7) and be collected into collection spaces 36. Any liquid can then subsequently drained, removed, and/or evaporated from portions of underlying surface 30. This can be advantageous as liquid can be channeled away and prevented from collecting or pooling on upper surfaces of the floor covering or joint system 10. In some aspects, liquid which can be funneled and collected in collection spaces 36 can subsequently be drained between adjacent planks of a deck, where the deck is the underlying surface 30. In further aspects, liquid may not drain through joint member 16, but can be physically removed via sweeping, blowing, etc. or allowed to evaporate from portions of underlying surface 30. Notably, joint member 16 can comprise an upper surface 16' having portions that are sloped, inclined, curved, and/or non-flat to improve the liquid channeling abilities of system 10, as liquid can more effectively flow, drain, and/or be swept away from the curved surfaces.

Collection spaces 36 can comprise a gap having, for example, a height of approximately 0.5 mm to approximately 10 mm and any dimension or sub-range therebetween. The height of collection space 36 can include a measurement of the distance between the bottom surfaces 12" and 14" of first and second floor panels 12 and 14 and the uppermost surface of underlying surface 30, such as along the left hand side of FIGS. 2A and 2B. The height of collection space 36 can further include a measurement of the distance between the bottom surface of joint member 16 and the uppermost surface of underlying surface 30 as seen in the middle portion of FIGS. 2A and 2B. The height of collection space 36 can also include a measurement of the distance between the bottom surface of first or second floor panels 12 and 14 and an upper surface of foot portion 38 as seen in the right hand side of FIGS. 2A and 2B. Collection space 36 can have a height of any suitable dimension for collecting and subsequently draining or removing liquid, such as rain water. In some aspects, collection space 36 can have a height of approximately 2 mm to 5 mm, approximately 5 mm, approximately 5 mm to 7 mm, or greater than approximately 7 mm.

Leg portions 32 of joint member can comprise laterally extending foot portions 38 which can be substantially parallel to portions of tongue portions 26 and support portions 34. Foot portions 38 can be substantially parallel to leg portions 32. At least one foot portion 38 can be physically and mechanically connected, coupled, or joined with underlying surface 30. This can be advantageous, as system 10 can provide a floor covering having improved stability over underlying surface 30. In some aspects, system 10 can remain substantially stationary when installed over an underlying surface 30 and can also be easily removed and reinstalled over another surface. System 10 can comprise a mobile and jointed floor covering system. This can be advantageous as consumers can install attractive and secure flooring systems over an existing surface 30 that can resist movement when exposed to heavy rains and winds. System 10 can also be removed for cleaning purposes and/or for installation over another, different surface where desired.

Notably, the at least one foot portion 38 can be mechanically coupled to underlying surface 30 via any suitable fastener, attachment member, connector, glue, and/or adhesive. In some aspects, the at least on foot portion 38 can be provided with one or more openings or holes through which at least one optional mechanical coupling member 40 can be positioned. For example, in some aspects, a plurality of holes can be spaced along a length of joint member 16 and a plurality of optional mechanical coupling members 40 can be disposed therein. In some aspects, coupling member 40 can comprise a wood screw or an anchor screw that can be approximately 5 mm×35 mm or 5 mm×40 mm and stainless steel. In other aspects coupling member 40 can comprise a nail, rivet, bolt, clip, hook, clamp, dowel, key, latch, pin, lug or any other suitable fastener is contemplated. In some embodiments, portions of joint member 16 can be glued, soldered, or welded to portions of underlying surface 30, and can be either used alone or in combination with optional coupling member 40. Coupling member 40 can be disposed through portions of joint member 16 and underlying surface 30 for physical and mechanical linkage therebetween. Notably, coupling member 40 can be disposed below a portion of second floor panel 14 such that coupling member 40 is not visible from above. This can improve the aesthetic appearance and feel of system 10, as consumers will not be required to look at and/or traverse the plurality of coupling members 40.

As FIGS. 2A and 2B further illustrate, in some aspects, joint member can comprise an upper portion and a lower portion with body portion 24 disposed therebetween. Upper portion of joint member 16 can include one or more tongue portions 26. Lower portion of joint member 16 can include support, leg, and/or foot portions 34, 32, and 28 respectively. Upper portion and lower portions of joint member 16 can be adapted to retain portions of opposing floor panels therebetween. That is, lower groove definitions 22 of first and second floor panels 12 and 14, respectively, can be disposed about and/or retained by upper and lower portions of joint member 16, that is, between opposing tongue portions 26 and opposing support portions 34. Each panel can then be fixedly held between upper and lower portions of joint member 16, and can be disposed over or above portions of underlying surface 30.

Still referring to FIGS. 2A and 2B, portions of upper surface 16' of joint member 16 can be co-planar or non-planer with portions of upper surfaces 12' and 14' of first and second floor panels members 12 and 14, respectively. In some aspects, upper surface 16' of joint member can be disposed along a different, lower plane than upper surfaces 12' and 14' of first and second floor panels 12 and 14, respectively. Thus, a second gap generally designated G2 can be disposed between opposing lateral edges of first and second floor panels 12 and 14. That is, the floor covering system 10 can provide second gap G2 for adapted to allow for swelling and/or play between panels.

One or more third gaps generally designated G3 can be disposed between body portion 24 of joint member 16 and first and/or second floor panels 12 and 14. Third gaps G3 can be disposed proximate the interface of joint member 16 and floor panels to allow for swelling and/or play between panels. In some aspects, joint member 16 can, but does not have to be water permeable, porous, and/or include porous body sections for draining liquid.

Figure 3:
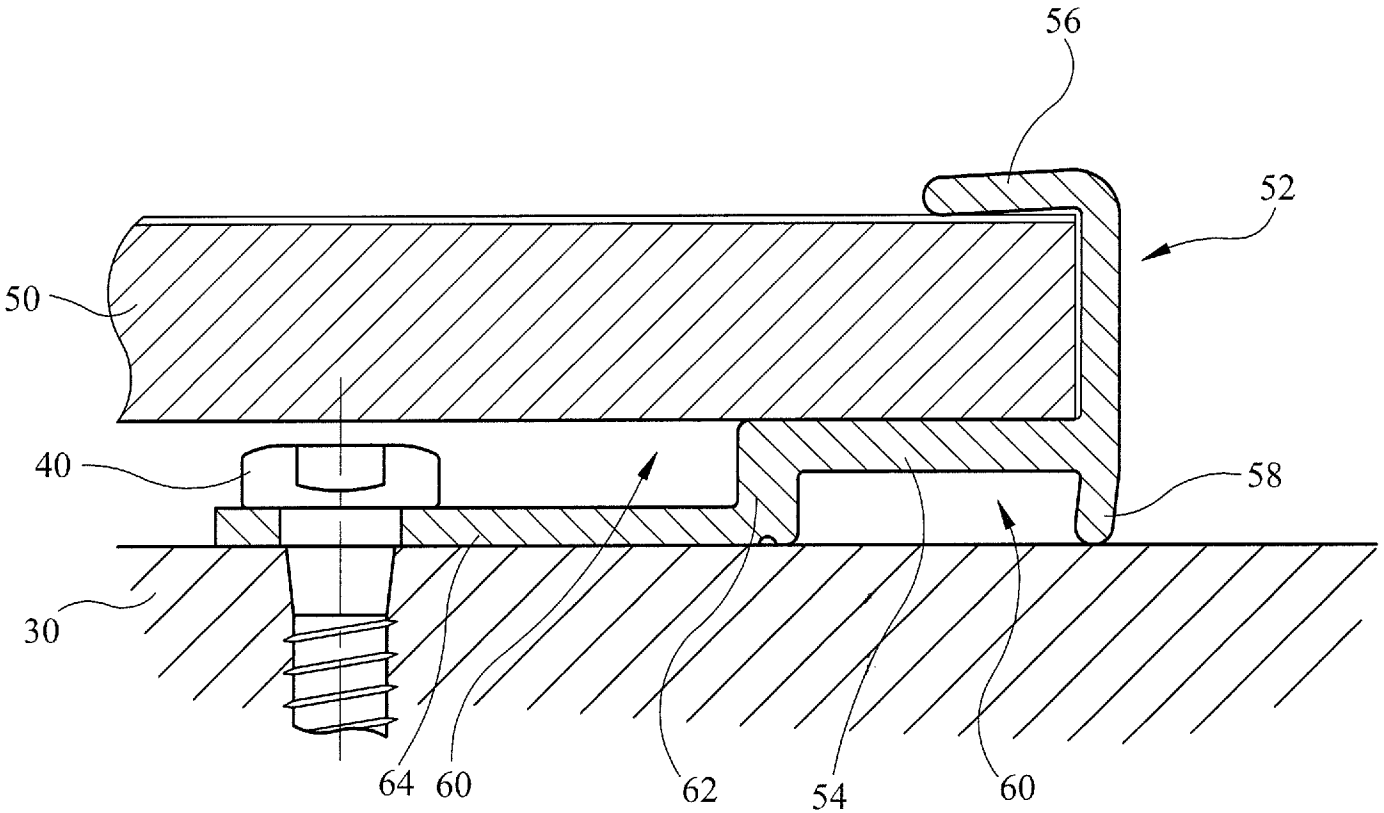
FIG. 3 is a sectional view illustrating an end member for joint devices and systems of floor panels according to the disclosure herein.

Referring to FIG. 3, floor covering or joint system 10 can further comprise an optional end component disposed about a portion of an outermost, end floor panel 50. End component, or end member generally designated 52 can be configured to engage, clip, click, snap, or lock about a portion of end floor panel 50. End member 52 can comprise a perimeter transition component for placement about a portion of the perimeter of the floor covering system 10, for example, about outermost floor panels within system 10. End member 52 can comprise an elongated strip (e.g., FIG. 7) which can be rollable and can be cut to size. End member 52 can comprise any suitable ridged, partially rigid, or flexible material such as an extruded metal or plastic. In some aspects, end member 52 can comprise a first retention portion 54 and a second retention portion 56. First and second retention portions 54 and 56 can be adapted to retain portions of floor panel 50 therebetween, for example, by engaging, snapping, and/or locking about opposing surfaces of floor panel 50. Notably, second retention portion 56 can be at least partially inclined or downwardly tapered for increasing an amount of force or friction applied by second retention portion 56 to end floor panel 50.

End floor panel 50 can be disposed over underlying surface 30, in some aspects, disposed above an underlying surface 30 such as above a surface of an existing deck. End member 52 can comprise at least a first leg portion 58. Notably, first leg portion 58 can be adapted to engage a second floor panel that is angled with respect to floor panel 50 (FIG. 4), or first leg portion 58 can be configured to raise or elevate a portion of floor panel 50 above underlying surface 30 forming a collection space 60 therebetween. Liquid, such as melting snow or rain water, can collect and subsequently be drained, removed from, and/or evaporated from collection spaces 60.

End member 52 can further comprise a second leg portion 62 extending from first retention portion 54. First and second leg portions 58 and 62 can in some aspects be substantially parallel to each other. First and second leg portions 58 and 62 can be substantially orthogonal to each of first and second retention portions 54 and 56, respectively. Collection spaces 60 can be disposed between portions of end floor panel 50 and underlying surface 30. This can advantageously provide a space or area for liquid, such as rain, to be funneled and subsequently drained between portions of underlying surface 30. A foot portion 64 can extend from second leg portion 62. Foot portion 64 can be substantially parallel to first and second retention portions 54 and 56, respectively. Foot portion 64 can be substantially orthogonal to first and second leg portions 58 and 62, respectively. Foot portion 64 can be substantially parallel with and disposed along a portion of the upper surface of underlying surface 30.

Notably, foot portion 64 can be fixedly mounted to a portion of underlying surface 30. This can advantageously anchor end member 52 over portions of underlying surface 30 to prevent substantial movement therebetween. Thus, gusty winds, adverse weather, or mere foot traffic would be prevented from unintentionally removing portions of system 10 from portions of underlying surface 30. In some aspects, foot portion 64 can be provided with an aperture or hole through which a coupling member 40 can be positioned. For example, in some aspects, a plurality of holes can be spaced along a length of end member 52 and a plurality of optional mechanical coupling members 40 can be disposed therein. In some aspects, coupling member 40 can comprise a wood screw or anchor screw. In other aspects coupling member 40 can comprise a nail, rivet, bolt, clip, hook, clamp, dowel, key, latch, pin, lug or any other suitable fastener.

In further embodiments, portions of end member 52 can be glued, soldered, or welded to portions of underlying surface 30 and can be either used alone or in combination with optional coupling member 40. Coupling member 40 can be disposed through portions of end member 52 and underlying surface 30 for physical and mechanical linkage therebetween. Notably, coupling member 40 can be disposed below a portion of end floor panel 50 such that coupling member 40 is not visible when viewed from above. This can improve the aesthetic appearance and feel of system 10 while also improving the stability of system, as consumers will not be required to look at and/or traverse a plurality of coupling members 40.

Figure 4:
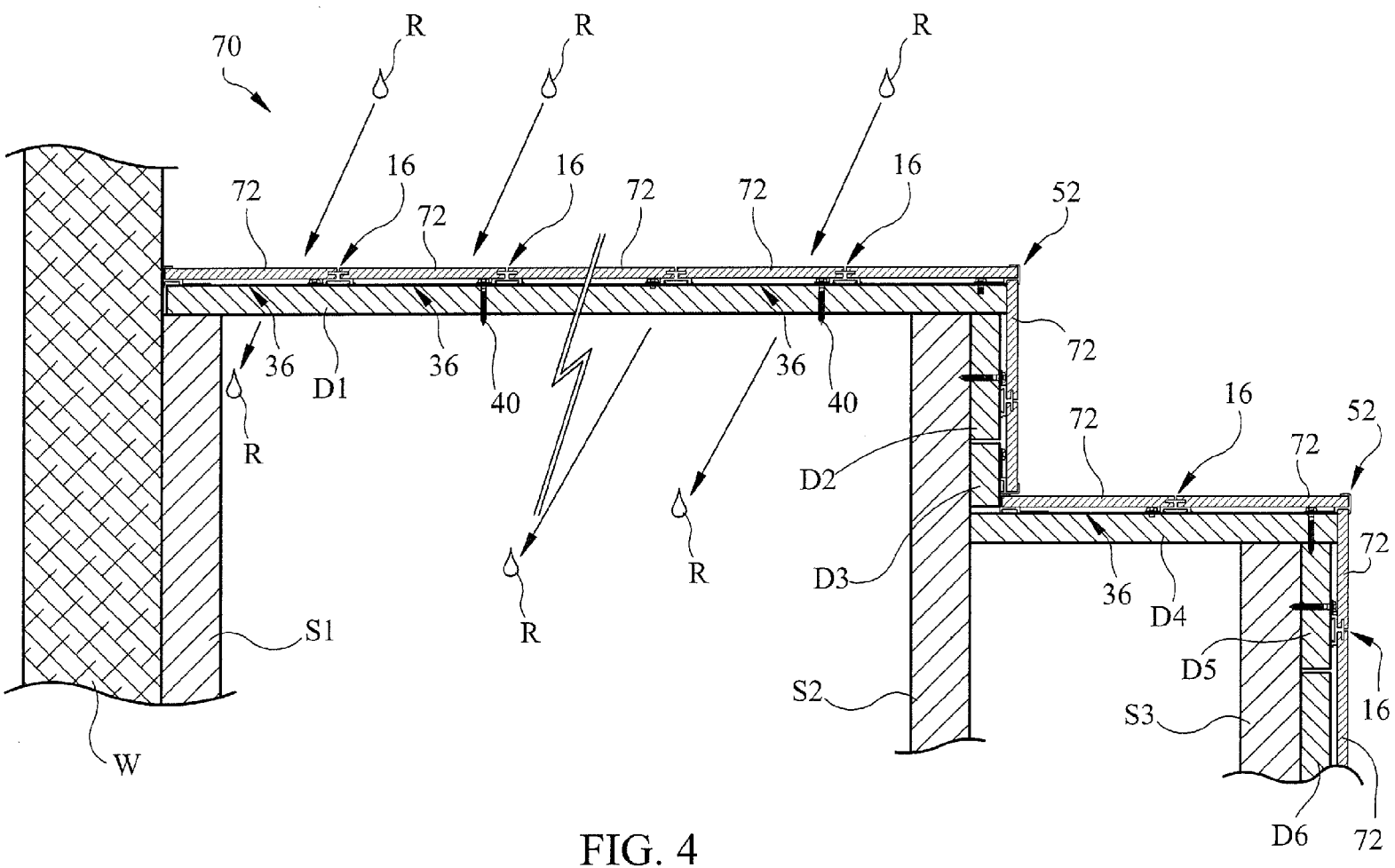
FIG. 4 is a side view illustrating exterior floor coverings according to the disclosure herein.

Referring now to FIG. 4, a floor covering or joint system generally designated 70 is shown. System 70 can comprise a plurality of panels 72 having a plurality of joint members 16 and/or end members 52 disposed therebetween. Notably, portions of joint members 16 and end members 52 can be mechanically coupled to portions of underlying deck panels or planks designated D1 to D6 via one or more coupling members 40. Mechanical coupling can be advantageous for several reasons, including for example stabilizing floor covering system 70 in case of inclement weather. Coupling members 40 can extend through portions of joint members 16 or end members 52 and portions of deck planks D1 to D6. Deck planks D1 to D6 can be any suitable size or shape. In some aspects, deck planks D1 to D6 can be approximately two feet (')×4'. In some aspects, deck planks D1 to D5 can comprise gaps or spaces therebetween such that liquid, including rain water R, can be channeled between panels 72 and can drain from the gaps or spaces between deck planks D1 to D5.

In some aspects, panels 72 can comprise long and short sides (e.g., rectangular panels) and can have a longitudinal axis. In one embodiment, a longitudinal axis of panels 72 can be substantially orthogonal to a longitudinal axis of the underlying surface, such as underlying deck planks D1 to D6 (see also FIG. 7). In other embodiments, the longitudinal axis of panels 72 can be substantially parallel to the longitudinal axis of deck planks D1 to D6. In yet further embodiments, the longitudinal axis of panels 72 can be angled with respect to the longitudinal axis of deck planks D1 to D6, for example, at any angle between approximately 1° and 89°, such as between approximately 15° and 25°, between approximately 25° and 45°, or between approximately 45° and 75°. Changing the angle at which the longitudinal axis of panels 72 are installed with respect to the longitudinal axis of deck planks may improve the efficiency at which liquid, such as rain water R, can be drained from deck planks. For example, rain water R may drain more efficiently when the longitudinal axis of panels 72 is substantially orthogonal to the longitudinal axis of deck planks D1 to D6, as a number of gaps between adjacent and underlying deck planks that become disposed below each panel 72 can be increased or maximized, allowing more rain water R to drain more efficiently from between adjacent, underlying deck planks.

Deck planks D1 to D6 can be supported by one or more optional deck structures or supports designated S1 to S3. Supports S1 to S3 can comprise any suitable structure and may not be required. In some aspects, supports S1 to S3 can for example comprise 4'×4' posts driven into the ground or underlying surface (not shown). One or more supports S1 to S3 can be disposed adjacent an exterior wall W, such as an exterior wall or siding of a house. Notably system 70 can be installed over an existing exterior structure, and can allow liquid such as rain water R to drain from portions of the existing structure.

Notably, at least one panel of the plurality of panels 72 can be installed at an angle with respect to at least one other panel of the plurality of panels 72 to cover angled surfaces. The angled panels can be directly adjacent to each other or non-adjacent. For example, one or more stairs are shown as disposed between supports S2 and S3. The stairs can be covered by one or more panels 72. At least one panel can be substantially orthogonal to at least one other panel. For illustration purposes, substantially orthogonal panels over substantially orthogonal deck surfaces have been shown, however, installing system 70 over inclined surfaces such as over portions of handicap ramps or other angled surfaces is also contemplated herein. A first panel of the plurality of panels 72 can be installed at any angle with respect to at least one other panel of the plurality of panels 72. In an alternative, a plurality of panels can be installed at a plurality of angles within system 70. For example, one or more panels 72 can be angled with respect to one or more other panels 72 between approximately 0 and 20°, between approximately 20° and 45°; between approximately 45° and 75°; or more than approximately 75°.

Notably, end members 52 proximate supports S2 and S3 can be adapted to engage more than one panel 72. For example, end member 52 can engage and/or lock about at least a first and a second panel of the plurality of panels 72, where the first and second floor panels are substantially orthogonal to each other between portions of the respective end members 52. End members 52 can also be installed adjacent each other, as illustrated proximate support S2 and deck plank D3.

FIGS. 5 to 7 illustrate further embodiments of joint systems for exterior floor coverings and joint devices. For example, FIG. 5 is a top perspective view of a system 80 for an exterior floor covering. System 80 can comprise at least a first floor panel 82, a second floor panel 84, and a joint disposed therebetween. The joint can be adapted to fill a gap between adjacent edges of first and second floor panels 82 and 84, respectively, and can be configured to effectively drain liquid between the panels. First and second floor panels 82 and 84 can be disposed over and/or above an underlying structure or surface, such as an outdoor patio or deck. That is, first and second floor panels 82 and 84 do not directly touch the underlying surface or structure. One or more gaps or spaces provided by elevating first and second floor panels 82 and 84 can be at least partially filled with an optional spacer material or spacer 100.

Spacer 100 can be disposed between portions of panel 82 and 84 and an underlying structure or surface 102. In some aspects, spacer 100 can comprise a porous, liquid permeable material and/or a mesh type structure adapted to allow liquid to drain or pass therebetween to portions of underlying surface 102 from which it can evaporate or drain, such as by allowing liquid to drain through cracks between adjacent decking panels or planks. First and second floor panels 82 and 84 and a joint device can comprise weatherproof materials suitable for outdoor use. In one embodiment, the joint between adjacent panels can comprise a discrete joint device or member that can be separate and distinct from first and second floor panels 82 and 84. In some aspects, the joint between panels 82 and 84 can comprise a joint member, generally designated 86.

First and second floor panels 82 and 84 can be similar in form and function to previously described floor panels 12 and 14 (FIG. 1). First and second floor panels 82 and 84 can comprise a single layer structure that can consist entirely of any substantially weather and water-resistant, water impervious, or waterproof material, a plastic material, or a wood plastic composite material suitable for exterior use. In other aspects, first and second floor panels 82 and 84 can comprise a multi-layered structure, as indicated by the broken lines in FIG. 1, where each layer can be the same material and/or different materials. Each entire first and second floor panel 82 and 84, and/or portions thereof, can comprise at least one layer of weatherproof plastic or composite material capable of withstanding exterior environmental conditions such as, for example, PVC or a wood plastic composite material. In some aspects, floor panels 82 and 84 can comprise a high pressure laminate adhered to a particle board such as TRICOYA®, designed and manufactured by MEDITE®.

Referring to FIGS. 5 and 6, joint member 86 can engage, click, snap and/or lock about portions of first and second floor panels 84 and 86. Portions of joint member 86 can be adapted to fittingly engage and/or snap or lock within portions of panels within system 80. Each of first and second floor panels 82 and 84 can comprise opposing edges disposed on outermost opposing lateral sides where each lateral edge is provided with at least one groove, generally designated 88. In some aspects, the at least one groove 88 can be longitudinally disposed along the length of opposing long edges of first and second floor panels 82 and 84, for example, where the panels are rectangular in shape. Groove 88 can be provided in first and second floor panels 82 and 84 via mechanical processing techniques including machining, milling, drilling, or any other suitable mechanical material removal process.

Each groove 88 of floor panels 82 and 84 can comprise a void adapted to engage a projection or tongue portion 90 of joint member 86, where groove 88 can be defined by at least an upper groove definition and a lower groove definition. Joint member 86 can comprise one or more tongue portions 90 which can extend outwardly from a body portion 92 of joint member, in opposite directions away from body portion 92. That is, tongue portions 90 can be disposed along opposing sides of joint member 86. In some aspects, joint member 86 can comprise a longitudinal strip or body having a substantially U-shaped cross-section, where body portion 92 can be centrally disposed between two leg portions with outwardly projecting and opposing tongue portions 90 extending therefrom. First and second floor panels 82 and 84 and joint member 86 can each be located a distance away from an underlying surface 102 and may not directly touch underlying surface 102. For example, floor panels 82 and 84 and joint member 86 can be disposed a distance above underlying surface 102. In some aspects, spacer 100 can comprise a collection space disposed between lower surfaces 82" and 84" of first and second floor panels 82 and 84, respectively, and underlying surface 102. Spacer 100 can also be disposed between portions of lower surface of joint member 86 and underlying surface 102. Spacer 100 can provide a collection area or space into which liquid from surfaces of system 80 can be funneled and drained. Notably, lower surfaces 82" and 84" of first and second floor panels can be co-planar with lower surface 86" of joint member 86.

Body portion 92 of joint member 86 can comprise an upper surface 92' that is non-planar with respect to upper surfaces 82' and 84' of first and second floor panels 82 and 84, respectively. In some aspects, upper surface 92' of joint member 86 is disposed on a lower plane than upper surface 82' and 84' of first and second floor panels 82 and 84, respectively. Tongue portions 90 of joint member 86 can also be disposed on a higher plane than upper surface 92' of body of joint member 86.

In some aspects, joint member 86 can comprise at least partially or entirely a flexible material. In some aspects, joint member 86 can be rollable such that it can be provided in a roll and subsequently cut to size. Joint member 86 can in some aspects comprise at least partially or entirely a plastic material or a wood plastic composite material that can be adapted to bend or flex along between first and second floor panels 82 and 84. This can be advantageous as portions of the underlying surface may not be substantially flat. Joint member 86 can comprise a natural or synthetic rubber material or an ASA plastic material that can be weather resistant, UV resistant (e.g., resistant to ultra violet (UV) light or sunlight) and heat resistant, thereby being advantageous for use in outdoor applications.

In further aspects, joint member 86 can comprise at least a partially or an entirely rigid or stiff material. For example, joint member can comprise a metal such as Al or alloys thereof. In some aspects, joint member 86 can be extruded. In other aspects, joint member 86 can comprise an anodized or plated metal, such as Al. Joint member 86 can be adapted to be water impervious and first and second floor panels 82 and 84 can be adapted to be fade resistant when exposed to sunlight. This can be advantageous, as floor panels within system 80 can maintain a given color point over time and not appear substantially faded or weathered soon after initial installation.

Notably, one or more holes or openings 94 can be provided in body 92 of joint member 86. Liquids, such as rainwater, cleaning solution, or melting snow, can be channeled directly from upper surfaces of adjacent first and second floor panels 82 and 84 downwardly between panels via openings 94. The liquid can pass into spacer 100 and eventually evaporate or drain from underlying surface 102 via cracks, pores, or gaps in underlying surface. Each joint member 86 can comprise a plurality of holes or openings 94 for effectively allowing large amounts of liquid to drain between first and second floor panels 82 and 84 from an upper surface of system 80 to prevent accumulation of liquid on the upper surface of the panels. Notably, joint member 86 can join or connect opposing edges of adjacent first and second floor panels 82 and 84 while at the same time allowing liquid to pass between the respective panels. Joint member 86 can be provided in a gap between first and second floor panels 82 and 84 thereby spacing the adjacent floor panels apart. System 80 can advantageously provide a jointed floor covering system adapted for outdoor use.

Each opening 94 can, for example, be the same width or diameter and/or different widths or diameters defined by at least one inner wall 96. The width or diameter of opening 94 can be approximately equal to or less than a width or diameter of body portion 92 of joint member 86. The gap space or between opposing grooves 88 of adjacent panels 82 and 84 can be longer in width and/or wider than the width or diameter of opening 94. Opening 94 can extend between upper surface 92' of body of joint member 86 and spacer 100 for passing funneled liquid into a collection area provided within portions of spacer 100. That is, spacer 100 can comprise a porous, liquid permeable, and/or mesh structured material having spaces therein for collecting liquid and eventually draining the collected liquid from portions of underlying surface 102. Openings 94 can comprise angled or tapered inner walls 96 and/or substantially straight inner walls 96 that can be configured to funnel liquid into a collection area comprised of spacer 100.

System 80 can optionally be attached and/or secured in place as a floor covering system. An optional mechanical coupling member or attachment member 98 can be inserted within a portion of opening 94 for allowing system 80 to be temporarily or permanently secured to underlying structure or surface 102 when so desired (e.g., during inclement weather, while sweeping, cleaning, high-power blowing, or power-washing panels). Liquid can still advantageously drain into opening 94 and out of the underlying structure 102 by flowing about attachment member 98. For example, where opening 94 comprises an elongated opening or slot, attachment member 98 can be secured within a portion of the slot such that the remaining portion of the slot can open into spacer. This can allow liquid to flow along inner walls 96, around attachment member 98, and then out from portions or areas around attachment member 98 which discharge liquid into a collection area comprising a water permeable spacer 100.

Openings 94 can be spaced apart at uniform and/or non-uniform intervals along a length of joint member 86. Openings 94 can facilitate effective draining of liquid, such as water from surfaces of adjacent floor panels. Joint member 86 and adjacent panels 82 and 84 can each comprise weatherproof materials suitable for use in outdoor applications. In some aspects, joint member 86 can comprise an extruded metal or plastic with an optional surfactant added thereto. A surfactant can advantageously prevent dirt or other debris from collecting inside openings 94. Joint member 86 can further include anti-microbial properties and be optionally treated with an anti-microbial agent to prevent or slow the growth of mold or mildew. For example, anti-microbial agents can comprise any suitable material such as metal ions, (e.g., silver (Ag) ions) which can be applied either during or after manufacture of joint member. In some aspects, the metal ions can be applied via spraying, dipping, and/or curtain coating portions of joint member 86. In further aspects, metal ions can be disposed within the weatherproof material or resin during manufacture.

Openings 94 can comprise an opening of any size, shape, orientation, and/or configuration. In some aspects, openings 94 can comprise liquid permeable and/or porous sections of material or porous body regions for draining water. That is, pores on the order of micrometer sized to millimeter sized can be disposed in areas and can collectively form "openings" 94 for effectively draining water. In other aspects, openings 94 can comprise elongated channels or slotted openings or areas disposed along the length of joint member 86. Slots can allow a larger quantity of liquid to collect and drain between panels and/or allow collected liquid to drain about attachment member 98 such that system 80 can be permanently or temporarily secured and attached to the underlying floor, while still being able to effectively drain liquid between panels.

In some aspects, system 80 can be assembled over existing outdoor surfaces to provide a weatherproof floor covering that is aesthetically appealing, easy to install, and durable. System 80 can comprise a floor covering adapted to easily cover at least a portion of an existing wooden deck such that the deck can be effectively covered without having to wash, sand, stain and/or re-finish the surface of the wooden deck. When covering an existing structure such as a wooden deck with the floor covering system 80, the existing deck should be structurally sound and relatively flat. Any rotted or warped boards may first need to be replaced.

In some aspects, joint member 86 can be installed at an angle and rotated to click and/or otherwise lock into grooves 88. In further aspects, joint member 86 can be tapped into grooves 88. Adjacent first and second floor panels 82 and 84 and joint member 86 can be unlocked and locked (e.g., re-joined) together multiple times such that system 80 can comprise a mobile and reusable floor covering. Joint member 86 can optionally comprise a decorative surface or surface design such that joint member 86 can also emulate the appearance of wood, wood grain, stone, tile, or brick surfaces.

It is also within the scope of the subject matter herein to manufacture the joint member 86 out of a solid, yet flexible and/or bendable material as noted previously, such as a natural or synthetic rubber. In this embodiment, the joint member 86 can flex or bend to allow for situations where the subsurface is not completely flat.

As FIG. 6 illustrates, attachment member 98 can extend through portions of joint member 86, spacer 100, and underlying surface 102. Spacer can comprise any suitable thickness, for example, from approximately 0.5 mm to 10 mm and any measurement or sub-range of measurements therebetween. For example, spacer 100 can comprise a thickness of approximately 2 mm, approximately 5 mm, between approximately 2 mm and 5 mm, or more than approximately 5 mm thick. As spacer 100 is optional, it may also be included in embodiment shown in FIGS. 1, 2A and 2B and/or may not be included in the embodiment shown in FIGS. 5 and 6. Spacer 100 can comprise an entangled mesh or net product for example, produced from an extruded polymer matrix of tangled monofilaments, which are heat-welded at the junctions. In one embodiment, spacer 100 can comprise the QUIET QURL® RF product (with the fiberglass mat removed) available from Keene Building Products of Mayfield Heights, Ohio. Spacer 100 can also include a ventilated molding material, for example as shown and described in U.S. Pat. No. 7,793,483, which is commonly owned and assigned, and the entire contents of U.S. Pat. No. 7,793,483 are incorporated by reference herein.

FIG. 7 is a schematic top view of a floor covering or joint system generally designated 110. System 110 can comprise a plurality of joint members 86 according to the disclosure herein. Notably, a plurality of adjacent floor panels P and a plurality of joint members 86 can be adapted to assemble together as indicated by the double sided arrows to cover an existing exterior floor structure or surface such as unsightly or aged surfaces of an outdoor patio or outdoor deck. The plurality of panels and joint members 86 can be parallel to each other and arranged such that their longitudinal axes are disposed along a same axis or direction. End members 52 are also schematically illustrated and are configured to assemble to outermost floor panels P. For illustration purposes, only two underlying deck planks designated D are shown, however, system 110 can be assembled over an entire deck or outdoor patio surface. Notably, the plurality of panels P does not directly touch portions of deck planks D. That is, the plurality of panels can be elevated over or disposed a distance away from deck planks D. Optional spacer 100 (FIG. 6) can be disposed between portions of the plurality of panels P and the deck planks D.

Floor panels P can be assembled with joint members 86 by rotating or tapping tongue portion (90, FIG. 6) of joint member 86 into grooves of adjacent floor panels P. Floor panels P can comprise non-structural (i.e., structural sub-flooring required) components such that when joined via joint member 86, panels P and joint member 86 can collectively establish a floor covering similar to an exterior area rug configured for application or installation directly over an existing exterior surface. Notably, portions of system 110 can be anchored to underlying deck planks D by securing attachment members such as screws into openings 94 of joint members 86. Openings 94 can provide spaces into which water or a liquid L can collect and evaporate or drain from gaps between deck planks D. That is, each floor panel P can be surrounded and configured to engage one, two, or more than two joint members 86 along one, two, or more than two edges. Notably, joint member 86 can be configured to engage adjacent grooves of adjacent panels P and lock the panels together. In some aspects, short sides of adjacent panels P can directly lock or join to each other via locking or clicking together on short sides. For example, panels P can comprise tongue portions 112 adapted to engage groove portions 114 and lock short sides of panels P together. Adjacent panels P can be directly locked or joined via engagement between the adjacent tongue 112 and groove 114 portions. Thus, in one embodiment, a first floor panel of the plurality of panels P can connect directly to at least one other panel along a first edge and directly to at least one joint member 86 along a second edge. For panels disposed in the center or middlemost region of system 110, a first floor panel of the plurality of panels P can connect directly to at least one other panel and at least two joint members 86. In further embodiments, as discussed above, short sides can optionally also connect to joint member 86 such that it is possible for at least one panel of the plurality of panels P to be connected on all sides directly to joint members 86.

Still referring to FIG. 7, system 110 can comprise intermediate joint members 86 disposed between and substantially parallel to long sides or edges of adjacent, rectangular shaped panels P. Joint members 86 can longitudinally align and/or abut end-to-end along the length of system 110 forming long channels for effectively draining liquid between panels P along the length of system 110. In other aspects, joint members 86 can be spaced apart when assembled end-to-end, and/or have ends configured to form an opening when assembled end-to-end for draining liquid therebetween. Deck planks D can comprise a longitudinal axis along a first axis $X_1$ or along a first direction. Panels P, end members 52 and/or joint members 86 can comprise a longitudinal axis disposed along a second axis $X_2$ or a second direction. First and second axes $X_1$ and $X_2$ can be angled and/or substantially orthogonal to each other such that a longitudinal axis of panels P can be substantially orthogonal the longitudinal axis of deck planks D. This can increase the efficiency at which liquid can drain from system 110, as openings 94 can be disposed over a large number of gaps between underlying adjacent deck planks D.

In sum, novel devices, systems, and methods are disclosed herein. Liquid, such as rain water, melted snow, or water used to clean the novel devices and systems, can be channeled into collection areas where it can collect and either subsequently drain between boards, cracks, or pores of the underlying deck or patio structure, be cleaned or blown out, or from where it can evaporate. In some aspects, a liquid permeable spacer can define and/or be disposed within the collection space. Such devices and systems can be impervious to liquids and therefore, suitable for exterior, outdoor use. The novel devices, systems, and methods can be installed quickly and easily over existing structures or surfaces without having to replace or refinish the existing surface. Notably, devices, systems, and methods disclosed herein are configured for DIY projects thereby saving the time and expense associated with hiring a contractor or contacting out a job. The novel devices, systems, and methods can be configured to replace floor panels that are angled with respect to each other. In each embodiment disclosed herein, novel devices and systems can include providing floor panels spaced apart from and not directly touching the underlying surface or structure, an optional spacer or portion of a joint member can be disposed therebetween.

Embodiments of the present disclosure shown in the drawings and described above are exemplary of numerous embodiments that can be made within the scope of the appended claims. It is contemplated that the novel devices, systems, and methods described herein can comprise numerous configurations other than those specifically disclosed.

What is claimed is:

1. A joint device for an exterior floor covering, the joint device comprising:

a body portion, wherein the body portion is disposed between an upper portion and a lower portion of the joint device;

at least two tongue portions extending from the body portion in opposite directions transverse to a longitudinal direction of the joint device, the tongue portions being adapted for positioning between one or more panels of an exterior floor covering;

wherein the joint device is adapted for outdoor use and adapted for securing portions of the exterior floor covering to portions of an underlying surface; and wherein the joint device is adapted to drain liquid from between adjacent floor panels, wherein the upper portion of the joint device comprises an upper surface of the tongue portions as well as a centrally located concave portion adapted for channeling the liquid to be drained;

wherein the body portion is elevated by support portions formed by legs extending from the body portion in an opposite direction transverse to a longitudinal direction of the joint device and underneath the tongue portions such that a collection space for the liquid to be drained is formed vertically underneath the concave portion; and wherein the joint device comprises at least one porous section adapted for draining the liquid, or wherein the body portion is adapted to pass liquid into a collection space below the joint device.

2. The joint device according to claim 1, wherein the joint device comprises multiple porous sections.

3. The joint device according to claim 1, wherein the collection space is disposed below the body portion of the joint device.

4. The device according to claim 1, further comprising at least one opening adapted to receive an attachment member for securing portions of the joint member to the underlying surface.

5. The joint device according to claim 4, wherein the opening is disposed in the body portion.

6. The joint device according to claim 4, wherein the opening is disposed in a foot portion extending away from the body portion.

7. The joint device according to claim 1, wherein the joint member comprises plastic.

8. The joint device according to claim 1, wherein the joint member comprises metal.

9. The joint device according to claim 1, wherein the joint member comprises a wood plastic composite material.

10. The joint device according to claim 1, wherein a portion of the joint member comprises an anti-microbial agent.

11. The joint device according to claim 1, wherein the upper and lower portions of the joint member are configured to support portions of the panel therebetween.

12. The joint device according to claim 11, wherein the upper and lower portions of the joint member are configured to elevate portions of the floor panel.

13. The joint device according to claim 1, wherein the legs extending from the body portion comprise first and second leg portions extending from the lower body portion.

14. The joint device according to claim 13, wherein first and second foot portions extend from the first and second leg portions.

15. The joint device according to claim 1, wherein a spacer is disposed in the collection space.

* * * * *

UNITED STATES PATENT AND TRADEMARK OFFICE

CERTIFICATE OF CORRECTION

PATENT NO. : 8,919,068 B2
APPLICATION NO. : 13/781088
DATED : December 30, 2014
INVENTOR(S) : Wright et al.

It is certified that error appears in the above-identified patent and that said Letters Patent is hereby corrected as shown below:

On the Title Page, Item (72) Inventors: should read

--Thomas S. Wright, Holly Springs, NC (US); Patrick George Smith, Raleigh, NC (US); Marc Schultze, Garner, NC (US); Nils-Erik Engstrom, Trelleborg, (SE)--.

Signed and Sealed this
Seventh Day of April, 2015

Michelle K. Lee

Michelle K. Lee
*Director of the United States Patent and Trademark Office*